US012442383B2

(12) United States Patent
Nielsen

(10) Patent No.: US 12,442,383 B2
(45) Date of Patent: Oct. 14, 2025

(54) FAN DRIVE SYSTEM

(71) Applicant: Danfoss Power Solutions Inc., Ames, IA (US)

(72) Inventor: Elias Nielsen, Nordborg (DK)

(73) Assignee: DANFOSS POWER SOLUTIONS INC., Ames, IA (US)

( * ) Notice: Subject to any disclaimer, the term of this patent is extended or adjusted under 35 U.S.C. 154(b) by 82 days.

(21) Appl. No.: 18/250,264

(22) PCT Filed: Dec. 20, 2021

(86) PCT No.: PCT/IB2021/022244
§ 371 (c)(1),
(2) Date: Apr. 24, 2023

(87) PCT Pub. No.: WO2022/144591
PCT Pub. Date: Jul. 7, 2022

(65) Prior Publication Data

US 2023/0417253 A1 Dec. 28, 2023

(30) Foreign Application Priority Data

Dec. 30, 2020 (DE) ..... 102020216601.3

(51) Int. Cl.
*F04D 27/00* (2006.01)
*F04D 25/04* (2006.01)

(52) U.S. Cl.
CPC ..... *F04D 27/004* (2013.01); *F04D 25/04* (2013.01)

(58) Field of Classification Search
CPC .. F04D 15/0066; F04D 15/02; F04D 15/0209; F04D 25/04; F04D 27/004;
(Continued)

(56) References Cited

U.S. PATENT DOCUMENTS 4,555,826 A * 12/1985 Rodgers ..... E01H 1/0845 15/340.3
6,023,138 A * 2/2000 Fried ..... F04D 27/008 318/434
(Continued)

FOREIGN PATENT DOCUMENTS

CN 101981322 A 2/2011
CN 102278334 A 12/2011
(Continued)

OTHER PUBLICATIONS

Extended European Search Report for European Patent Application No. 21188828.4, dated Jan. 26, 2022.
(Continued)

*Primary Examiner* — Michael J Tsai
*Assistant Examiner* — Charles W Nichols
(74) *Attorney, Agent, or Firm* — McCormick, Paulding & Huber PLLC

(57) ABSTRACT

The fan system includes a fan operated by a hydraulic motor which is driven by a hydraulic variable displacement pump that includes a displacement volume adjusting element. A tilt angle of the displacement volume adjusting element can be adjusted by controlling a tilt current supplied to an electronic displacement control unit. The hydraulic fan system further includes means for determining the volumetric flow rate of the pump and a control unit having: a signal connection to the means for determining the volumetric flow rate of the pump, a signal connection to a fan speed setting device, and a fan speed calculating unit for calculating a fan speed from the determined volumetric flow rate, a fan speed error determining unit for determining a fan speed error by comparing the calculated fan speed to the fan speed set by the fan speed setting device. The control unit can supply an adapted tilt current to the electronic displacement control unit in order to adjust the tilt angle of the displacement
(Continued)

volume adjusting device, such that the volumetric flow rate can be adapted in order to reduce the fan speed error, wherein an ideal tilt current value is derived from the calculated fan speed and safety actions are performed in order to prevent damage to the fan, if the difference between the ideal tilt current value and the adapted tilt current is higher than a tilt current threshold value.

15 Claims, 3 Drawing Sheets

(58) Field of Classification Search
CPC ..... F04D 27/008; F04D 29/04; F05D 2270/3061; Y02B 30/70; H02P 23/0004; H02P 23/14; H02P 23/20; H02P 29/10; F04B 1/295; F04B 1/324; F04B 3/007; F04B 3/0073; F04B 3/102; F04B 3/105; F04B 3/106; F04B 3/107; F04B 3/108; F04B 3/109; F01B 3/007; F01B 3/0073; F01B 3/102; F01B 3/105; F01B 3/106; F01B 3/107; F01B 3/108; F01B 3/109
See application file for complete search history.

(56) References Cited

U.S. PATENT DOCUMENTS 6,349,882 B1 2/2002 Kita et al.
6,481,388 B1 * 11/2002 Yamamoto ..... F01P 7/044 123/41.1
7,863,839 B2 * 1/2011 Schuricht ..... F01P 7/044 236/35
8,459,959 B2 * 6/2013 Imaizumi ..... F04B 1/324 60/329
2001/0042849 A1 11/2001 Yamamoto et al.
2009/0025661 A1 1/2009 Itoga et al.
2010/0205953 A1 * 8/2010 Bettin ..... F04D 25/04 60/459
2011/0011356 A1 1/2011 Tanaka et al.
2011/0293439 A1 * 12/2011 Imaizumi ..... F04D 25/08 417/42
2015/0033728 A1 2/2015 Glaz et al.
2015/0337871 A1 11/2015 Du

FOREIGN PATENT DOCUMENTS

CN 102362053 A 2/2012
CN 216751579 U 6/2022
DE 10 2013 214 807 A1 2/2015
EP 2 261 509 A1 12/2010
EP 2 270 321 A1 1/2011
EP 2 412 948 A1 2/2012

OTHER PUBLICATIONS

Summary English translation of Chinese Office Action, in connection with corresponding Chinese Pat. App. No. 202111065462.8, dated Dec. 7, 2024.
International Search Report mailed on Mar. 21, 2022, in connection with corresponding International Application No. PCT/IB2021/022244; 4 pages.

* cited by examiner

FAN DRIVE SYSTEM

CROSS-REFERENCE TO RELATED APPLICATIONS

This application is a National Stage application of International Patent Application No. PCT/IB2021/022244, filed on Dec. 20, 2021, which claims priority to German Patent Application No. 102020216601.3, filed on Dec. 30, 2020, each of which is hereby incorporated by reference in its entirety.

TECHNICAL FIELD

The present invention relates to a method for controlling the speed of a hydraulic fan system and to a hydraulic fan system.

BACKGROUND

Hydraulic fan systems are widely applied in the field of work machines, e.g., in road sweeping devices. Those vehicles are often propelled by an internal combustion engine which drives a hydraulic pump. The hydraulic pump is hydraulically connected to a hydraulic motor which, for example, drives a fan in order to generate an air flow through a suction device of the vehicle.

In the state of the art, hydraulic fan systems are often equipped with hydraulic means for controlling the speed of the fan. These hydraulic controlling means normally provide poor efficiency and only limited options to control the fan speed, and are pressure controlled (load dependent), which means that once the suction fan or a grill covering the suction fan gets blocked, the fan speed will increase until a sufficient airflow is regained. This can have negative consequences since the fan can accelerate to overspeed which may cause damage to the fan. To prevent such fan overspeeds, hydraulic orifices or valves can be arranged in the hydraulic circuit between the pump and the motor, which valves reduce the pressure at the motor inlet once the hydraulic flow exceeds a certain limit. If the motor inlet pressure is reduced by such valves efficiency losses will occur making today's fan drive systems rather inefficient. Additionally, the current operational state of fan drive systems according to the state of the art is not monitored, such that a machine operator does not have any insights into the working behavior of the machine and cannot identify potential hazards, e.g. a blockage of the fan grill during the operation of the machine.

For example, US 2009/0025661 A1 discloses a drive system for a cooling fan of a working machine. The rotation speed of the cooling fan is controlled towards an optimum rotation speed depending on the cooling water temperature. Minimum and maximum limiters are used to calculate a target displacement angle, which in turn is used to calculate a target control current.

In US 2011/0011356 A1, a device for controlling a cooling fan is shown. The cooling fan is driven by a hydraulic motor fed by a hydraulic pump. Depending on various measured values acquired, the supply to the hydraulic motor is adjusted by a volume flow adjuster. A target flow rate controller sets a target value for the flow rate supplied to the hydraulic motor.

US 2011/0293439 A1 discloses a device for reducing the loss of a volume flow of pressurized hydraulic oil when the rotational speed of a fan provided for cooling is increased to a target rotational speed. For this purpose, an acceleration characteristic is provided which is predetermined by an acceleration characteristic setting unit based on, among other things, the rotational speed of the cooling fan.

SUMMARY

It is therefore an object of the invention to provide a hydraulic fan drive system which is capable of controlling the fan speed independent from the hydraulic fluid flow in the associated circuit. Such a control increases the efficiency of the fan drive system as hydraulic losses can be reduced. Additionally, a control independent from the fluid flow of the fan speed prevents damage to the hydraulic fan system. It is another object of the invention to provide a method to control the speed of a hydraulic fan system and to provide a hydraulic fan system which is capable of sending notifications to a machine operator, derived from and about the current state of the hydraulic fan system. The inventive system shall also be capable of identifying failure conditions, e.g., a blockage of main system components.

The object of the invention is solved by a method for controlling the (rotational) speed of a hydraulic fan system according to claim 1, and by a hydraulic fan system according to claim 8.

A hydraulic fan system according to the invention comprises a fan operated by a hydraulic motor. The hydraulic motor is driven by a hydraulic variable displacement pump comprising a displacement volume adjusting element whose tilt angle is controllable by a tilt current supplied to an electronic displacement control unit (EDC). In the sense of the present invention description, tilt current, which is also called pump current or pump control current, is the electric current provided to a tilt angle adjusting means capable of setting a tilt angle, wherein the magnitude of the tilt current provided to the tilt angle adjusting means determines the tilt angle.

The method for controlling the speed of a hydraulic fan system comprises the following repetitive steps:

In a first step a), the operational parameters of the pump are measured to determine the volumetric flow rate of the pump, e.g., by a means for measuring at least the rotational speed of the pump and the tilt angle of the displacement volume adjusting element, or by other comparable variables. Apart from the rotational speed of the pump and the tilt angle of the displacement volume adjusting element, the volumetric flow rate of the pump could, for example, be determined by measuring an intake power and the pressure difference between the pump inlet and pump outlet of the pump. However, it is common knowledge of a person skilled in the art to measure, or determine, other comparable variables in order to determine the volumetric flow rate.

In a second step b), a fan speed is calculated based upon the determined volumetric flow rate as in step a), using equations representing the fan system. These equations can be physical equations, e.g., a state space matrix or model which serves as a digital twin of the hydraulic fan system. The equations could also be used in the form of a neural net, which assigns a value of fan speed to an input value of volumetric flow rate after having received training data in the form of, for example, measurements from a real or idealized model hydraulic fan system.

In step c), a fan speed error value is determined by comparing the calculated fan speed of step b) with a fan speed set value. The fan speed set value can not only be preset by an operator, the value can also be set by a control unit. The fan speed set value can also be set by means of a mechanical interface, whereby the mechanical movement of a fan speed setting device is converted into an electrical signal representing the fan speed set value. This electrical signal can then be compared with an electrical signal representing the calculated fan speed.

In step d), the tilt current supplied to the electronic displacement control unit in order to adjust the tilt angle of the displacement volume adjusting element is adapted. The tilt angle of the displacement volume adjusting element is thereby adjusted such that the fan speed error can be reduced. Many different solutions of how a tilt current can result in an adjustment of the tilt angle of the displacement volume adjusting element are available. For example, the tilt current could be provided to a solenoid which acts on a swashplate—for example, serving as a displacement volume adjusting element in order to tilt the swashplate and therefore to adjust the tilt angle. If the tilt angle of the displacement volume adjusting element is changed in a direction such that the fan speed error is reduced, the fan speed of the hydraulically operated fan will approach the fan speed set value. This guarantees a stable operating behaviour of the hydraulic fan system.

In a step e), an ideal tilt current is derived from the calculated fan speed of step b) assuming an ideal behavior of the fan system. This ideal tilt current represents the current that should be provided to the electronic displacement control device (EDC), in order to operate the fan at a certain speed if the hydraulic fan system would be operated under ideal conditions, i.e. without the influence of disturbances, or at least without the influence of unpredictable disturbances.

In step f), safety related functions/actions are performed in order to prevent damage to the fan, e.g., preventing fan over-speeding if the difference between the ideal tilt current and the tilt current adapted in step d) is higher than a predefined tilt current threshold value. If the ideal tilt current deviates significantly from the adapted tilt current it is probable that disturbances may occur during the operation of the hydraulic fan system.

In this case, it may be preferable to perform certain safety related actions resulting from operation under the impact of disturbances, for example: by sending a warning message to a control interface, or by shutting down of the system in order to avoid severe damage to the hydraulic fan system or the fan (blades). By defining the magnitude of a deviation threshold value the system operator may choose between setting a rather low threshold value, which would evoke safety actions already when the difference between the ideal tilt current and the provided tilt current is low, or defining a higher threshold value leading to a more disturbance-tolerant system behaviour.

In one embodiment of the invention, additional steps e) and f) are executed at least partially time-parallel (simultaneous) to the steps c) to d). In context to the invention the phrase "time-parallel" or simultaneous is not limited to executing the steps c) and e) in parallel and, afterwards, executing steps d) and f). "Time-parallel" is to be treated as substantially parallel in time which means that, e.g., steps c), e) and f) can be executed simultaneous to the aforementioned, and as an alternative option. However, a person with relevant skills in the known art may apply a different working order to the embodied steps, for example, performing step c), then step e), then step f) and eventually step d). All sequences of the steps c) to f) which start after step b) and end before starting the method according to the invention with step a) again are covered by the inventive concept.

In another embodiment of the invention, a speed error threshold value can be defined. By doing this, a threshold level can be set for taking actions if the fan speed error exceeds this threshold level. Here, one can think about initiating tilt current adaptation or taking safety actions as mentioned before. By defining the magnitude of the speed error threshold value, the sensitivity of the hydraulic fan system to disturbances can be set; the smaller the speed error threshold value, the higher the sensitivity of the method for controlling the speed of a hydraulic fan system.

The method according to the invention can be applied for controlling hydraulic fan drive systems, in which the hydraulic pump and/or the hydraulic motor are operated in an open or in a closed hydraulic circuit. It is also covered by the invention to arrange additional hydraulic components of the same, or an alternative type, in the hydraulic circuit of the fan system providing additional functionality and/or safety features to the hydraulic fan system.

The method according to the invention may be applied to hydraulic pumps and/or hydraulic motors, wherein the displacement volume adjusting element is a swashplate or a yoke. In other words, the method can also be applied to bent axis, or to swashplate pumps, or motors.

In one embodiment of the invention a shutdown valve may be arranged hydraulically in-between the pump and the motor. The shutdown valve comprises a first safety position in which the hydraulic fluid flow between the pump and the motor is reduced or even interrupted, ultimately until the motor speed is reduced to a stop, and a second operational position in which the pump and the motor are hydraulically connected for operating the fan.

In step f), the shutdown valve can be switched from the operational position to the safety position if the difference between the provided tilt current and the ideal tilt current, or the fan speed error, is higher than the predefined tilt current threshold value or higher than the predefined speed error threshold value. For example, threshold values defined to prevent damage to the fan due to fan overspeed. One possible embodiment of a functional safety action is to switch the shutdown valve from the operational position to the safety position. The shutdown valve can be a two-position valve, or a proportional valve depending on the desired application. If the shutdown valve is a two-position valve, the switching of the shutdown valve from its operational position to its safety position will disconnect the hydraulic pump from the hydraulic motor, and therefore shut down the hydraulic motor, which in turn causes the fan to stop/stand still. If the shutdown valve is a proportional valve switching from the operational to a safety position will lead to a lower pressure at the motor inlet, reducing the torque and the speed of the fan. This may ultimately lead to the valve reaching its closed position, wherein the fan speed also decreases until it stops.

An additional or alternative function to switching the shutdown valve in step f) is to send a warning message to an operator, and/or to a control interface, and/or to a user interface of the fan system, and/or to a work machine the fan system is installed to if the difference between the provided tilt current and the ideal tilt current, or the fan speed error is higher than the correspondent predefined threshold value. After receiving this warning notice the system operator, or the control interface, can perform additional safety actions in order to eliminate disturbances and thereby readjust the system behavior towards the ideal system behaviour. According to the invention, other safety measures like an electrical shutdown of the machine, reducing the engine speed, or initiating a cleaning of the suction system or air intake grill in order to eliminate disturbances may also be performed. A person skilled in the art knows many other ways of performing safety actions in order to respectively maintain the system behaviour, and to prevent damage to the drive fan or the hydraulic fan system.

The adaption of the tilt current in step d) can be calculated based of the fan speed error using a P-, PI-, PID-, Fuzzy- or predictive controller, or a similar type of linear or non-linear controller. The adequate control architecture will be chosen by a person skilled in the art depending on the application and the computing power available. The parameters of any of the aforementioned controllers may be tuned in order to obtain a rather swift, or alternatively slow controller response. The application of computational intelligence methods like, e.g., neural networks, or the application of predictive controllers are also covered by the invention.

The ideal tilt current can be derived in step e) from a look-up table, a matrix, a function, or a similar data structure which assigns a value of ideal tilt current to every value of calculated fan speed. The data structures may be set up using measurements obtained from simulations, or experiments, with the inventive hydraulic fan system or by using the results of a model-based calculation of the hydraulic fan system. The data structures could not only represent ideal system behavior but may also comprise an average disturbance that influences an ideal system behavior. This second option slows down/limits the response of the inventive safety system to disturbances being outside these average/usual disturbances.

A hydraulic fan system according to the invention comprises a fan operated by a hydraulic motor. The fan and the motor can be, e.g. connected by a shaft and/or a gearbox or similar which transfers the torque generated by the hydraulic motor to the fan. The system further comprises a hydraulic variable displacement pump for driving the hydraulic motor, comprising a displacement volume adjusting element that can be tilted, wherein the angle of tilt can be adjusted by means of controlling a tilt current supplied to an electronic displacement control unit. The variable displacement pump and the hydraulic motor are hydraulically connected such that hydraulic pressure at the pump outlet is transferred to the inlet of the hydraulic motor. The displacement volume adjusting element can, for example, be a swashplate, which can be tilted such that the volumetric flow and/or the displacement volume of the variable displacement pump can be adjusted. The tilt angle can be changed by means of controlling a tilt current supplied, for example, to an electronic displacement control device, which can be a solenoid, for example, acting on the displacement volume adjusting element thereby changing its tilt angle, which therefore leads to a change of the volumetric flow through the variable displacement pump. The hydraulic fan system further comprises a means for determining the volumetric flow of the pump. As there are various ways for determining the volumetric flow rate of the pump which are obvious to a person skilled in the art, and the skilled person will choose an appropriate solution for the selected application.

In a further embodiment the hydraulic fan system further comprises a control unit. The control unit comprises another signal connection to the means for determining the volumetric flow rate of the pump, and a signal connection to a device for setting the fan speed. As mentioned before, the means for determining the volumetric flow rate of the pump, e.g. a rotational speed sensor and a tilt angle measurement sensor can be selected from a wide range of devices. The fan speed setting device may, for example be a control interface, or a joystick. Both signal connections are not limited to any physical restrictions, i.e. the connection may be established via wires or as a wireless connection, and/or the connection may be a bus-system or any other communication structure.

The control unit further comprises a fan speed calculating unit for calculating a fan speed based on the determined volumetric flow rate. The fan speed calculating unit may comprise means for storing a calculation rule and/or the measured values on the base of which the fan speed could be determined. The control unit further comprises a fan speed error determining unit for determining a fan speed error by comparing the calculated fan speed to the fan speed set by the fan speed setting device. Based on this comparison, the control unit provides an adapted tilt current to the displacement volume control unit, such that the volumetric flow rate can be adapted in order to reduce the fan speed error. As mentioned earlier, the displacement volume, or the volumetric flow rate of the hydraulic variable displacement pump, are adapted by adjusting a tilt current provided to the displacement control unit of the pump or motor unit.

The control unit can comprise a controller for calculating the tilt current which is provided/supplied to the electronic displacement control unit based on the determined fan speed error. This adaptation of the current can be directly or indirectly derived from the fan speed error, e.g., by applying a control architecture, e.g., a PI or PID controller. If a computer or microcontroller is used as control unit the fan speed calculating unit, the fan speed error determining unit and the fan grill blockage detection unit can be designed as separate computers, or devices, according to the inventive concept, or as units that share the same computer and/or microcontroller and/or device according to the inventive concept.

The control unit could further comprise a fan grill blockage detection unit for performing functional safety actions in cases where, for example, the fan grill is blocked with dirt or debris. These actions may prevent damage to the fan, due to, for example, preventing the fan from over-speeding. Safety critical actions may be performed if the difference between the adapted tilt current and an ideal tilt current derived from the calculated fan speed, i.e. the fan speed error, is higher than a predefined threshold value. If the tilt current and the ideal tilt current differ significantly a malfunction of the hydraulic fan system is likely. The ideal tilt current represents the tilt current which would be necessary if the system was operated under ideal or optimal conditions. Actions which may be evoked by the fan grill blockage detection unit may be safety critical, and for example: shutting down the fan system, sending notifications, reducing the fan torque or the fan speed, changing the relevant calculation parameters, i.e. the parameters responsible for the calculation of a tilt current based on the fan speed error, or similar safety critical measures.

The fan grill blockage detection unit according to the invention can be capable of switching a shutdown valve which is hydraulically arranged between the hydraulic pump and the hydraulic motor. The shutdown valve comprises an operational position in which the pump and the motor are hydraulically connected, and a safety position in which the hydraulic connection between the pump and the motor is interrupted. The shutdown valve may be implemented as two-position valve with the two aforementioned positions, or as proportional valve wherein the fluid connection between the pump and the motor is fully open in the operational position of the shutdown valve, and is gradually reduced the more the shutdown valve is switched towards its safety position. The fan grill blockage detection unit is capable of switching this shutdown valve by, for example, applying a hydraulic pressure to a shutdown valve spool, or by acting on the shutdown valve spool by means of a solenoid if the difference between the adapted tilt current and the ideal tilt current, or the fan speed error, is higher than the predefined threshold value for the fan speed error.

According to another embodiment of the invention concept, the shutdown valve may additionally comprise a spring forcing the shutdown valve into its safety position. During operation the shutdown valve is forced into its operational position by means of the fan grill blockage detection unit acting against, or providing, a signal to act against the force of the spring only if the difference between the supplied/adapted tilt current and the ideal tilt current, or the fan speed error, is lower than a correspondent predefined threshold value for the tilt current or the fan speed error. Alternatively, or additional to being capable of switching the shutdown valve the blockage detection unit can be capable of sending warning messages or notifications, or other signals, to an operator, to a control interface, or a user interface of the fan system, or to a device to which the fan system is installed to if the difference between the supplied tilt current and the ideal tilt current, or the fan speed error, is higher than the correspondent predetermined threshold value.

As mentioned earlier, there are many options available to a person skilled in the art in determining the volumetric flow rate of the pump. The volumetric flow rate can either be measured directly by a flow sensor, or indirectly by measuring other parameters from which the volumetric flow rate can be calculated. The volumetric flow rate can, for example, be calculated based on the rotational speed of the pump measured by a rotational speed sensor and—based on a displacement tilt angle of the pump measured—by a tilt angle sensor.

The measurements and/or calculations can be stored in a memory unit in order to be accessible for error detection condition monitoring, predictive maintenance or a similar purpose. Especially, the values of; volumetric flow rate, fan speed, fan speed error, tilt current and/or ideal tilt current are of specific interest as they allow conclusions about the current state of wear of the system, or about disturbances influencing the system such as for example, dirt or debris blocking the fan grill.

According to the invention, the displacement volume adjusting element of the hydraulic motor and/or pump can be swashplate or a yoke. In other words, bent axis or swashplate pumps or motors can be used.

The inventive hydraulic fan system may be used as a hydraulic suction or blowing system, or as a hydraulic ventilation device in a hydraulic work vehicle or machine. The hydraulic work vehicle could be, for example a road sweeping device or road/pathway maintenance vehicle, or snow clearing vehicle.

BRIEF DESCRIPTION OF THE DRAWINGS

The invention described in general, as above, is now further detailed with the help of annexed Figures, in which preferred embodiments and preferred design possibilities are shown. However, these preferred embodiments do not limit the scope of the inventive idea. The shown preferred embodiments can be combined with one another without leaving the spirit of the invention. Furthermore, modifications within the possibilities of the knowledge of a person with skills in the relevant art can be implemented without leaving the spirit of the invention. In the Figures it is shown.

DETAILED DESCRIPTION

Figure 1:
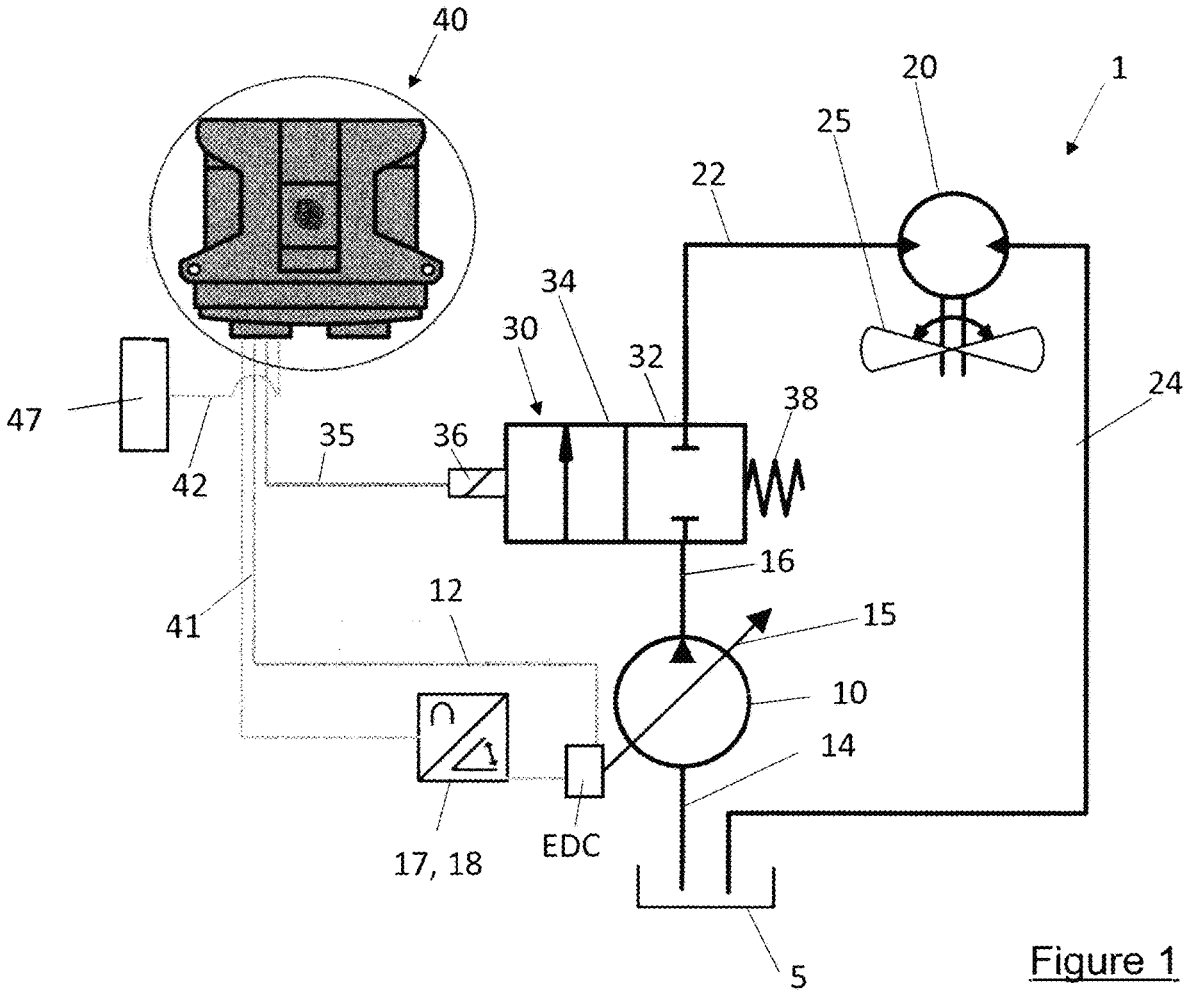
FIG. 1 shows a hydraulic diagram of a hydraulic fan system according to the invention.

FIG. 1 shows a hydraulic fan system 1 according to the invention, comprising a fan 25, which is connected to a hydraulic motor 20 via shaft and/or gear means. The outlet of the hydraulic motor 20 is connected via a motor outlet line 24 to a hydraulic tank 5. A hydraulic pump 10 with variable displacement is hydraulically connected to the tank 5 via a pump suction line 14. The pump outlet is connected via a pump pressure line 16 to a shutdown valve 30, wherein the outlet of the shutdown valve 30 is hydraulically connected to the motor inlet line 22, which is capable of transferring hydraulic pressure to the inlet line 22 of the hydraulic motor 20.

The shutdown valve 30 comprises a safety position 32, also called shutdown position, and an operational position 34. A spring 38 retains the shutdown valve 30 in its shutdown/safety position 32, if it is not counteracted by a force exerted by a shutdown valve actuator 36. The shutdown valve 30, which is shown in FIG. 1, is designed as a two-position valve which is switchable between the safety position 32 and the operational position 34. In the safety position 32, the pump pressure line 16 and the motor inlet line 22 are hydraulically disconnected, whereas in the operational position 34, the pump pressure line 16 and the motor inlet line 22 are hydraulically connected. However, the shutdown valve 30 could also be designed as proportional valve providing an opening which can be reduced proportionally to the force of the shutdown valve actuator 36. The shutdown valve actuator 36 is connected via a safety action signal connection 35 to a control unit 40, which is capable of sending safety action signals 52 (see FIGS. 2 and 3).

The hydraulic pump 10 comprises a displacement volume adjusting element 15, controlling the volumetric flow rate 19 of the pump 10. The volumetric flow rate 19 of the pump 10 is determined by means of a rotational speed sensor 17 and a tilt angle sensor 18, which are connected to the control unit 40 via a volumetric flow rate signal connection 41. The control unit 40 is furthermore capable of sending a tilt current 12 to an electronic displacement control unit (EDC) coupled to the displacement volume adjusting element 15. The tilt angle of the displacement volume adjusting element 15 is set according to the tilt current 12.

Figure 2:
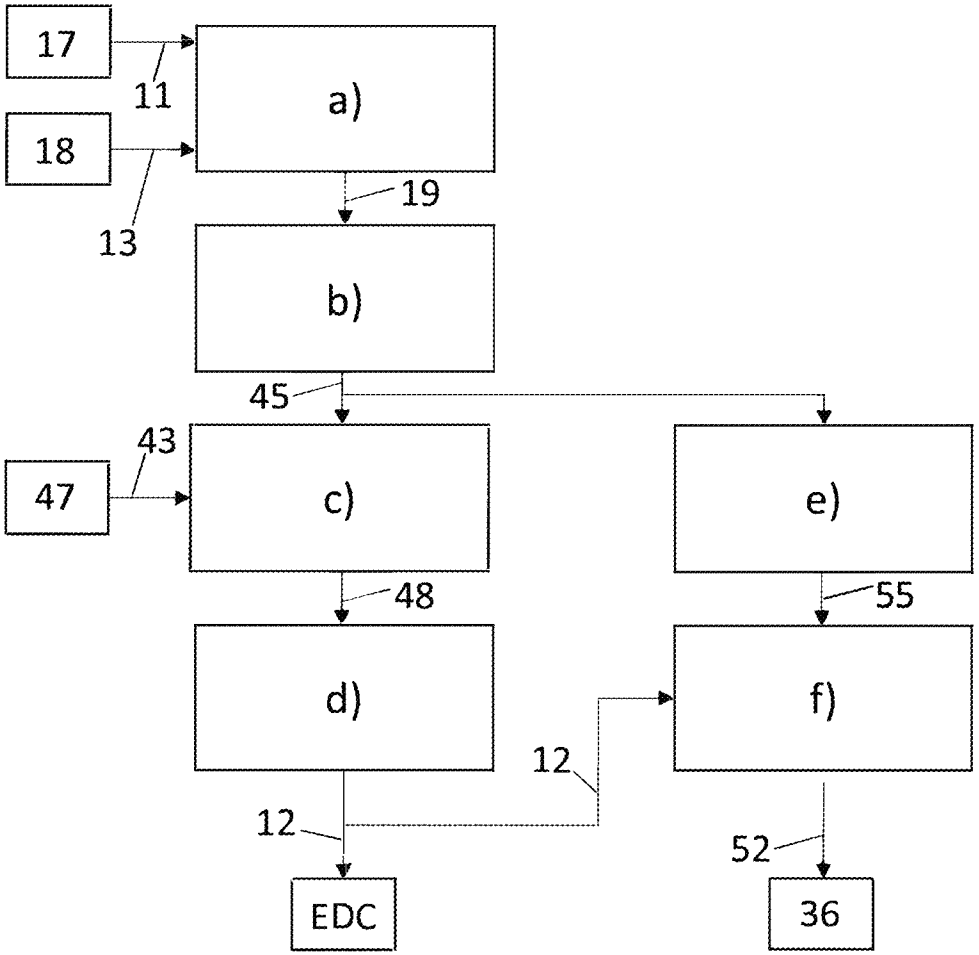
FIG. 2 shows a flow diagram of a method for controlling the speed of a hydraulic fan system according to the invention.

FIG. 2 shows a flow chart of a method for controlling the speed of a hydraulic fan system 1, exemplarily shown in FIG. 1, comprising the steps a) to d) and e) to f). The method can be applied for controlling hydraulic systems comprising a fan 25, which is operated by a hydraulic motor 20 driven by a hydraulic variable displacement pump 10. The hydraulic variable displacement pump 10 comprises a displacement volume adjusting element 15, e.g., a swashplate or yoke, whose tilt angle 13 is controlled by a tilt current 12 supplied to an EDC. The method according to the invention as depicted in FIG. 2 comprises the following steps, which are executed repeatedly and/or periodically (See FIG. 1 for reference system elements):

Step a) The volumetric flow rate 19 of the hydraulic pump 10 is determined by means of measuring operational parameters of the hydraulic system. The volumetric flow rate 19 of the pump 10 can exemplarily be determined by means for measuring the rotational speed 11 of the pump 10 and the tilt angle 13 of the displacement volume adjusting element 15. As the tilt angle 13 of the displacement volume adjusting element 15 is directly influencing the displacement volume of the hydraulic pump 10, the volumetric flow rate 19 of the pump 10 can, in this example, be calculated by multiplying the rotational speed 11 of the pump 10 with the displacement volume per revolution of the pump 10. Alternatively, the volumetric flow rate of the pump 10 could be measured more directly using a volumetric flow rate sensor, which may be installed in a hydraulic line 16 connecting the pump outlet with the motor inlet line 22.

Step b) A fan speed 45 is calculated based on the volumetric flow rate 19 in step a), using equations representing the fan system 1. The equations represent the technical correlation between the volumetric flow rate 19 and the fan speed 45 and can be derived by creating a physical model of the hydraulic fan system 1 or by training a neural net suitable for assigning a value of fan speed 45 to a correspondent value of volumetric flow rate 19 with training data that is, for example, measured during the operation of the hydraulic fan system 1.

Step c) A fan speed error 48 is determined by comparing the calculated fan speed 45 of step b) to a fan speed set value 43 set by a fan speed setting device 47, e.g. according to an operator input. The comparison is exemplarily executed by subtracting the fan speed value 45 calculated in step b) from the fan speed set value 43.

Step d) A tilt current 12, which is provided to the electronic displacement control unit (EDC), is adapted in order to adjust the tilt angle 13 of the displacement volume adjusting element 15, so that the fan speed error 48 is reduced. In other words, a tilt current 12 is calculated based on the fan speed error 48 determined in step c), and is sent to the electronic displacement control unit (EDC) in order to adjust the tilt angle 13 of the displacement volume adjusting element 15, for example, a swashplate or a yoke. Thereby, the volumetric flow rate 19 of the pump 10 increases or decreases.

The tilt current 12 may be supplied to a solenoid acting upon the displacement volume adjusting element 15, setting the tilt angle 13 of the displacement volume adjusting element 15 in proportion to the tilt current.

Given the case that the fan speed set value 43 is higher than the calculated fan speed 45, the tilt current 12 may be adapted in a direction, such that the tilt angle of the displacement volume adjusting element 15 is increased which leads to an increased volumetric flow rate 19 of the pump 10, and therefore to a higher calculated fan speed 45. Therefore, the fan speed error 48 between the fan speed set value 43 and the calculated fan speed 45 is reduced if, for example, a proportional controller (P-Controller) is installed the fan speed error 48 is multiplied by a constant factor do determine the tilt current 12. However, a person skilled in the art knows various types of controllers applicable for calculating a tilt current adaptation based on the fan speed error 48.

As shown in FIG. 2, steps e) and f) are executed substantially simultaneously to the steps c) and d). In step e), an ideal tilt current is derived from the calculated fan speed 45, wherein an ideal behavior of the fan system 1 is presumed. Starting from the calculated fan speed 45 in step e), an ideal tilt current value 55 is determined by, for example, the help of a Look-up table, a Matrix, or similar method in which the relationship between the fan speed and tilt current under ideal conditions, is described. This means that to every calculated fan speed 45, an ideal tilt current value 55 can be associated. Here, different physical models or disturbances can be considered at a theoretical level.

In the following step f), the ideal tilt current value 55 determined in step e) is compared to the tilt current value 12 adapted in step d) and supplied to the electronic displacement control device EDC. If the difference between the two currents is higher than a predefined threshold value, safety actions 52 are executed to prevent damage to the fan 25, e.g., due to the fan over-speeding. Fan over-speeding may occur if e.g., the volumetric flow rate 19 or the pressure in the inlet line 22 of the hydraulic motor 20 is such that the pressure drop across the hydraulic motor 20, or the volumetric flow rate 19 through the hydraulic motor 20 is too high. This leads to very a high torque and/or rotational speed at the shaft connecting the fan 25 to the hydraulic motor 20.

A predefined threshold value can define how swift the hydraulic fan system 1 reacts to deviations from this ideal behavior. The higher the predefined threshold value is set, the slower or the later (smoother) the system will react to disturbances, which lead to an increase or decrease of the delivered tilt current in comparison to the ideal tilt current.

Figure 3:
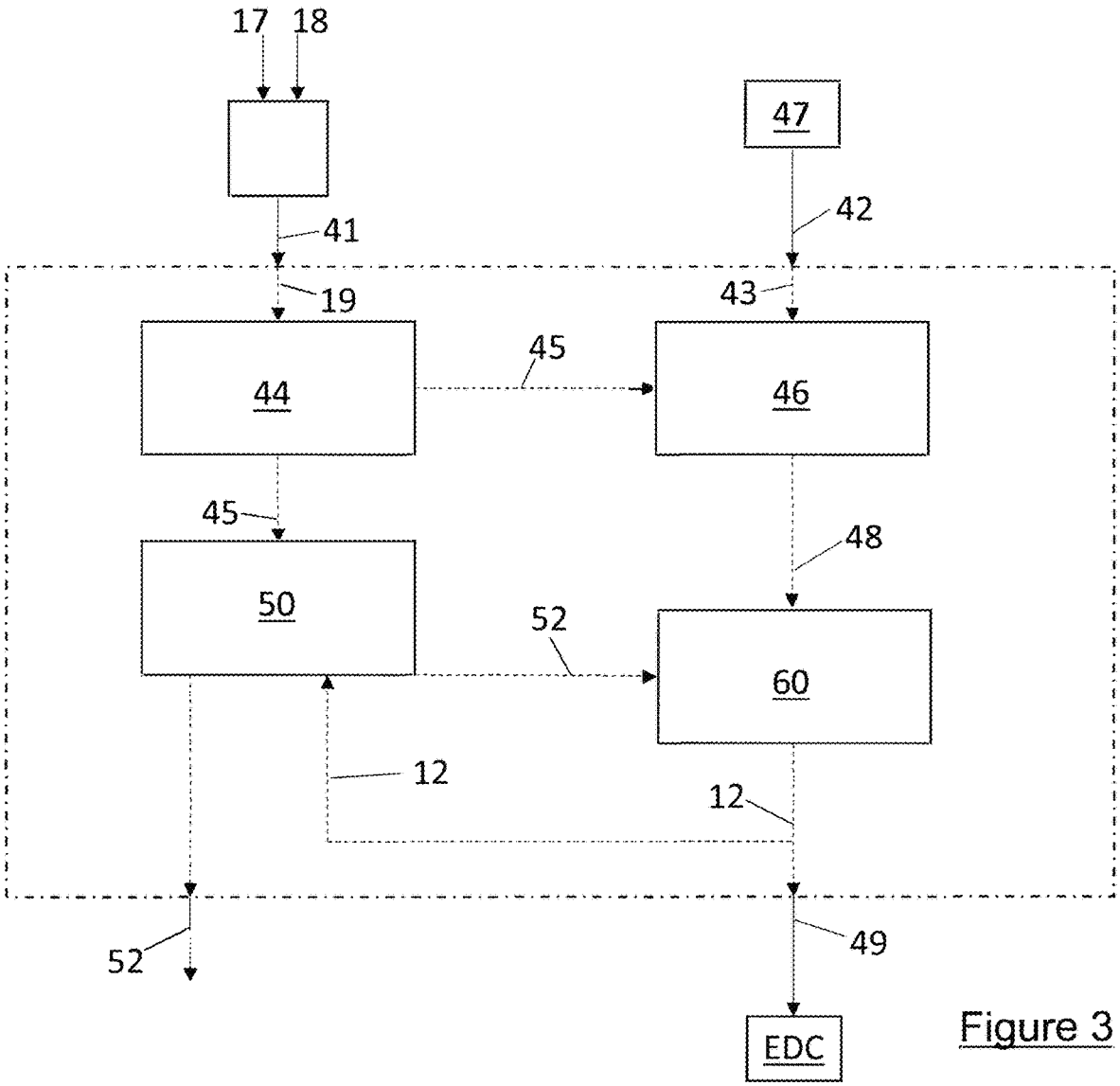
FIG. 3 shows a schematic diagram of a control unit according to the invention.

FIG. 3 shows a schematic diagram of a control unit 40 according to the invention. In FIG. 3, the solid arrows represent physical connections outside of the control unit 40, wherein the dashed lines represent communication parameters inside the control unit 40, which can be shared via physical connection but can also be exchanged virtually between the sub-units of the control unit 40. The control unit 40 comprises a volumetric flow rate signal connection 41, via which the sensors 17, 18 for determining the rotational speed 11 of the pump 10 and the tilt angle 13 of the displacement volume adjusting element 15 are connected to the control unit 40. The control unit 40 further comprises a fan speed set value signal connection 42 for receiving the fan speed set value 43 from a control interface or a similar fan speed setting device 47. The sensor signals 17 and 18, which are sent via the signal connection 41, are processed in a fan speed calculating unit 44, which calculates a fan speed 45 based on the sensor signals 17 and 18. The calculated fan speed 45 is internally distributed to a fan speed error determining unit 46 and to a fan grill blockage detection unit 50. The fan speed error determining unit 46 is capable of determining a fan speed error 48 by comparing the calculated fan speed 45 to the fan speed set value 43. Based on the fan speed error 48, a controller 60 provides/supplies an adapted tilt current 12 as output of the control unit 40 to an electronic displacement control unit EDC via a tilt current line 49.

A fan grill blockage detection unit 50 is capable of performing functional safety actions 52, which can either be sent as an output of the control unit 40, or can be processed internally of the control unit 40 in order to adapt the calculation of the tilt current 12 based on the fan speed error 48 performed by the controller 60. The fan grill blockage detection unit 50 selects and calculates which safety critical actions should be performed based on the calculated tilt current 12 and the calculated fan speed 45, wherein the fan grill blockage detection unit 50 is capable of deriving an ideal tilt current 55 from the calculated fan speed 45 in order to compare it to tilt current 12 supplied to the electronic displacement control unit EDC.

If the provided tilt current 12 deviates from the ideal tilt current 55 more than a predetermined tilt current threshold value, control unit 40 evokes safety critical actions for example reducing the current provided to shutdown valve actuator 36, in order to reduce, or close, the hydraulic connection between pump pressure line 16 and motor inlet line 22, or reducing, or interrupting, the current supply to the electronic displacement control unit EDC, in order to tilt back the displacement volume adjusting element 15 and thereby reducing the volumetric flow via motor inlet line 22 to hydraulic motor 20.

From the above disclosure and accompanying Figures and claims, it will be appreciated that the method for controlling the speed of a hydraulic fan system and the hydraulic fan system according to the invention offer many possibilities and advantages over the prior art. It will be appreciated further by a person skilled in the relevant art that further modifications and changes to the methods for controlling the speed of hydraulic fan systems and the hydraulic fan systems known in the art could be made to the method and the hydraulic fan system according to the invention without parting from the spirit of this invention, therefore all these modifications and changes are within the scope of the claims and covered by them. It should be further understood that the examples and embodiments described above are for illustrative purposes only and that various modifications, changes or combinations of embodiments in the light thereof, which will be suggested to a person skilled in the relevant art, are included in the spirit and purview of this application.

What is claimed is:

1. A method for controlling the speed of a hydraulic fan system comprising a fan operated by a hydraulic motor which is driven by a hydraulic variable displacement pump comprising a displacement volume adjusting element whose tilt angle can be adjusted by means of controlling a tilt current supplied to an electronic displacement control unit, the method comprising the following repetitive steps:

a) Determining a volumetric flow rate of the hydraulic variable displacement pump by means of measuring operational parameters of the hydraulic variable displacement pump;

b) Calculating a fan speed based on the volumetric flow rate determined in step a) using equations representing the physical correlation between the volumetric flow rate and the fan speed;

c) Determining a fan speed error by comparing the calculated fan speed of step b) with a fan speed set value provided by an input device;

d) Determining a tilt current adaptation supplied to the electronic displacement control unit in order to adjust the tilt angle of the displacement volume adjusting element, such that the fan speed error is reduced, wherein the tilt current adaptation is calculated based on the fan speed error using a P-, PI-, PID-, Fuzzy- or a Predictive Controller or a similar type of linear or non-linear controller;

wherein the following steps are executed simultaneously to the steps c) to d):

e) Deriving an ideal tilt current value from the calculated fan speed of step b);

f) Performing safety actions in order to prevent damage to the fan, if the difference between the ideal tilt current value derived in step e) and the tilt current adaptation determined in step d) is higher than a tilt current threshold value, and wherein a warning signal is sent to an operator, to a control interface, or to a user interface of the fan system, or to a work machine hosting the fan system, if the tilt current threshold value or the speed error threshold value is exceeded.

2. The method according to claim 1, wherein safety actions for preventing damage to the fan are performed, if the fan speed error determined in step c) is higher than a speed error threshold value.

3. The method according to claim 1, wherein in step f) a shutdown valve is switched from an operational position in which the hydraulic variable displacement pump and the hydraulic motor are hydraulically connected, to a safety position in which the hydraulic connection between the hydraulic variable displacement pump and the motor is reduced or interrupted.

4. The method according to claim 1, wherein the ideal tilt current value in step e) is derived from a Look-Up-Table, a matrix, a function or a similar data structure which maps every value of calculated fan speed to a value of the ideal tilt current.

5. A hydraulic fan system comprising:

a fan operated by a hydraulic motor;

a hydraulic variable displacement pump for driving the hydraulic motor, comprising a tiltable displacement volume adjusting element whose tilt angle can be adjusted by means of a control unit controlling a tilt current which can be supplied to an electronic displacement control device;

a fan speed setting device for setting a fan speed set value according to an input command;

means for determining the volumetric flow rate of the hydraulic variable displacement pump;

wherein the control unit comprises:

a volumetric flow rate signal connection to the means for determining the volumetric flow rate of the hydraulic variable displacement pump;

a fan speed set value signal connection to the electronic displacement control device;

a fan speed calculating unit for calculating a fan speed based on the determined volumetric flow rate;

a fan speed error determining unit for determining a fan speed error by comparing the calculated fan speed with the fan speed set value set by the fan speed setting device; and wherein the control unit is capable of adapting the tilt current supplied to the electronic displacement control device such that the tilt angle can be adjusted in order to reduce the fan speed error, wherein a tilt current adaptation is calculated based on the fan speed error using a P-, PI-, PID-, Fuzzy- or a Predictive Controller or a similar type of linear or non-linear controller, and wherein the control unit further comprises a fan grill blockage detection unit assigning to each calculated fan speed an ideal tilt current value, comparing the ideal tilt current value to the value of the tilt current adapted by means of the control unit, and performing safety actions for preventing damage to the fan, if the difference between the ideal tilt current value and the adapted tilt current value is higher than a tilt value, and wherein the fan blockage detection unit is capable of sending a warning message to an operator, to a control interface or to a user interface of the fan system, or to a host device if the tilt current threshold value is exceeded.

6. The hydraulic fan system according to claim 5, wherein the control unit is capable of performing safety actions for preventing damage to the fan, if the fan speed error determined by the fan speed error determining unit is higher than a speed error threshold value.

7. The hydraulic fan system according to claim 5, wherein the fan grill blockage detection unit is capable of switching a shutdown valve from a safety position, in which the hydraulic connection between the pump and the motor is reduced or interrupted, to an operational position, in which the pump and the motor are hydraulically connected, if the tilt current threshold value is not exceeded.

8. The hydraulic fan system according to claim 7, wherein the shutdown valve is forced into its operational position by means of the fan grill blockage detection unit against the force of a spring, if the tilt current threshold value is not exceeded.

9. The hydraulic fan system according to claim 5, wherein the volumetric flow rate of the hydraulic variable displacement pump is determined based on the rotational speed of the hydraulic variable displacement pump measured by a rotational speed sensor, and based on the tilt angle of the displacement volume adjusting element measured by a tilt angle sensor.

10. The hydraulic fan system according to claim 5, wherein the values of volumetric flow rate, fan speed, fan speed error, tilt current and/or ideal tilting current are stored in a memory unit, in order to be accessible for error detection, condition monitoring, predictive maintenance or a similar purpose.

11. The hydraulic fan system according to claim 5, wherein the hydraulic variable displacement pump and the motor are operated in an open or in a closed hydraulic circuit.

12. The hydraulic fan system according to claim 5, wherein the displacement volume adjusting element is a swashplate or a yoke.

13. Use of the hydraulic fan system according to claim 5, as hydraulic suction or blowing system, or as hydraulic ventilation device in a hydraulic work vehicle or machine.

14. Use of the hydraulic fan system according to claim 13, wherein the hydraulic work vehicle is a road sweeping device.

15. The method according to claim 2, wherein in step f) a shutdown valve is switched from an operational position in which the pump and the motor are hydraulically connected, to a safety position in which the hydraulic connection between the pump and the motor is reduced or interrupted.

* * * * *